US007162178B2

(12) United States Patent
Takiguchi et al.

(10) Patent No.: US 7,162,178 B2
(45) Date of Patent: Jan. 9, 2007

(54) TRANSFER DEVICE AND IMAGE FORMING APPARATUS

(75) Inventors: Toshiki Takiguchi, Yamatokoriyama (JP); Hiroshi Tachiki, Yamatokoriyama (JP); Hirokazu Yamauchi, Uji (JP); Hiroyuki Murai, Gose (JP); Yoshiaki Masuda, Nara (JP); Fumio Shimazu, Nara (JP); Masashi Hirai, Katano (JP)

(73) Assignee: Sharp Kabushiki Kaisha, Osaka (JP)

( * ) Notice: Subject to any disclaimer, the term of this patent is extended or adjusted under 35 U.S.C. 154(b) by 170 days.

(21) Appl. No.: 11/002,708

(22) Filed: Dec. 1, 2004

(65) Prior Publication Data

US 2005/0117932 A1 Jun. 2, 2005

(30) Foreign Application Priority Data

Dec. 2, 2003 (JP) ..... P2003-403017

(51) Int. Cl.
*G03G 15/16* (2006.01)

(52) U.S. Cl. ..... 399/101

(58) Field of Classification Search ..... 399/101
See application file for complete search history.

(56) References Cited

U.S. PATENT DOCUMENTS 6,002,905 A * 12/1999 Matsuda ..... 399/303
2005/0078972 A1* 4/2005 Soda et al. ..... 399/44

FOREIGN PATENT DOCUMENTS

| | | |
|---|---|---|
| JP | 07-168454 | 7/1995 |
| JP | 08-179640 | 7/1996 |
| JP | 09-006150 | 1/1997 |
| JP | 10-133489 | 5/1998 |
| JP | 2000-250326 | 9/2000 |

* cited by examiner

*Primary Examiner*—Vincent Q. Nguyen
(74) *Attorney, Agent, or Firm*—David G. Conlin; David A. Tucker; Edwards Angell Palmer & Dodge LLP

(57) ABSTRACT

A timer clocks and accumulates time periods during each of which a recording sheet is transported or transfer bias is applied as transfer execution periods. When the accumulated value reaches a predetermined value, the timer outputs a time-up signal to a CPU and then clears the accumulated value. The CPU executes a cleaning operation at the time the time-up signal is inputted from the timer. In the cleaning operation, the CPU causes a high-voltage power source to apply cleaning bias to a transfer electrode roller while causing a high-voltage power source to apply delivery bias to an auxiliary cleaning roller, in order to return toner attracted to the auxiliary cleaning roller to a photosensitive drum via a transfer belt.

11 Claims, 8 Drawing Sheets

TRANSFER DEVICE AND IMAGE FORMING APPARATUS

CROSS REFERENCE

This Nonprovisional application claims priority under 35 U.S.C. § 119(a) on Patent Application No. 2003-403017 filed in Japan on Dec. 2, 2003, the entire contents of which are hereby incorporated by reference.

BACKGROUND OF THE INVENTION

The present invention relates to a transfer device having an endless transfer carrier for use in electrophotographic image formation processing performed by such apparatus as a copying machine, printer and facsimile for example, as well as an image forming apparatus incorporating the transfer device.

Transfer devices of the charger type have been commonly used in electrophotographic image forming apparatus in view of their simplified structures. Such a transfer device produces ozone during electric discharge for obtaining a transfer output, which raises a problem of unpleasant odor and harm to humans' health. For this reason, transfer devices of the contact type have become predominant in these years.

Such contact-type transfer devices are classified into two types, one type being adapted to bring a transfer electrode, such as an electrically conductive roller or brush, into direct contact with the reverse side of a recording sheet to transfer a toner image formed on an image carrier to the recording sheet, the other type being adapted to achieve transfer with use of a transfer carrier, such as an electrically conductive endless belt or film, which intervenes between the image carrier and the recording sheet.

In a transfer device of the latter type using the transfer carrier intervening between the image carrier and the recording sheet, the transfer carrier plays the role of electrostatically attracting a recording sheet thereto for an image to be transferred from the image carrier to the recording sheet and then transporting the recording sheet to fixing means while peeling the recording sheet from the image carrier by keeping the recording sheet electrostatically attracted thereto.

The transfer carrier is applied with transfer bias having a reverse polarity relative to that of charged toner for electrostatically attracting the recording sheet and transferring the image formed on the image carrier. As a result, toner adhering to the image carrier that has not been transferred to the recording sheet is undesirably attracted to the transfer carrier and hence soils the reverse side of a fresh recording sheet to be electrostatically attracted subsequently.

To prevent such an inconvenience, cleaning means is provided for removing toner from the surface of the transfer carrier. Generally-used cleaning means include: means operative to scrape toner adhering to the transfer carrier by contacting the transfer carrier and collect the toner into a collecting container, as disclosed in Japanese Patent No. 3452287 for example; and cleaning means operative to return toner adhering to the transfer carrier to the image carrier by switching transfer bias applied to a transfer bias applying member to cleaning bias having a reversed polarity, as disclosed in Japanese Patent No. 3312800.

The former cleaning means is capable of cleaning the transfer carrier constantly. However, the cleaning means requires the provision of a collecting container for storing collected toner, which leads to upsizing of the apparatus.

The latter cleaning means is incapable of cleaning during image formation. For this reason, in forming an image on multiple recording sheets successively, it is likely that the cleaning means permits toner to soil the reverse side of each recording sheet undesirably.

Further, since the surface potential at a portion of the image carrier directly contacted by the transfer carrier applied with the transfer bias is substantially lower than that at a portion of the image carrier indirectly contacted by the transfer carrier via a recording sheet, a larger amount of toner adheres the transfer carrier via the image carrier, thus soiling an end portion of the reverse side of the recording sheet seriously.

In attempt to solve this problem, there has been provided a transfer device including an auxiliary cleaning member operative to temporarily contact the transfer carrier to hold toner, wherein the auxiliary cleaning member is caused to attract toner adhering to the transfer carrier during successive image formation and then return the attracted toner to the image carrier via the transfer carrier upon completion of image formation on a predetermined number of recording sheets, as disclosed in Japanese Patent No. 3386265.

With this transfer device, however, it is possible that the amount of toner to be attracted by the auxiliary cleaning member exceeds the toner attracting and holding capacity of the auxiliary cleaning member in the case where the size of recording sheets used is relatively large, where the transfer device incorporates a transfer bias controller or the like for controlling the transfer bias depending on the type of recording sheets used, or where a toner replenishing operation is performed, or in a like case. This results in a problem that the auxiliary cleaning member becomes incapable of completely attracting all the toner adhering to the transfer carrier.

A feature of the present invention is to provide a transfer device capable of returning toner to the image carrier via the transfer carrier with controlled timing after having caused an auxiliary cleaning member to attract toner adhering to the transfer carrier thereto and temporarily hold the toner thereon thereby cleaning the transfer carrier reliably, as well as an image forming apparatus incorporating the same.

SUMMARY OF THE INVENTION

According to the present invention, there is provided a transfer device including: an endless transfer carrier entrained about plural support members and movable along a looped path; a bias applying section operative to selectively apply transfer bias or cleaning bias to the transfer carrier; an auxiliary cleaning member operative to temporarily attract thereto toner adhering to the transfer carrier; and a control section for executing a transfer operation including an operation of causing the bias applying section to apply the transfer bias to the transfer carrier to transfer toner from a surface of an image carrier to a recording sheet being transported by the transfer carrier, and an operation of causing the auxiliary cleaning member to attract thereto the toner adhering to the transfer carrier, wherein the control section is operative to determine execution timing for a cleaning operation including returning the toner attracted to the auxiliary cleaning member to the image carrier via the transfer carrier based on an amount of execution of the transfer operation.

The foregoing and other features and attendant advantages of the present invention will become more apparent from the reading of the following detailed description of the invention in conjunction with the accompanying drawings.

DETAILED DESCRIPTION OF THE INVENTION

Figure 1:
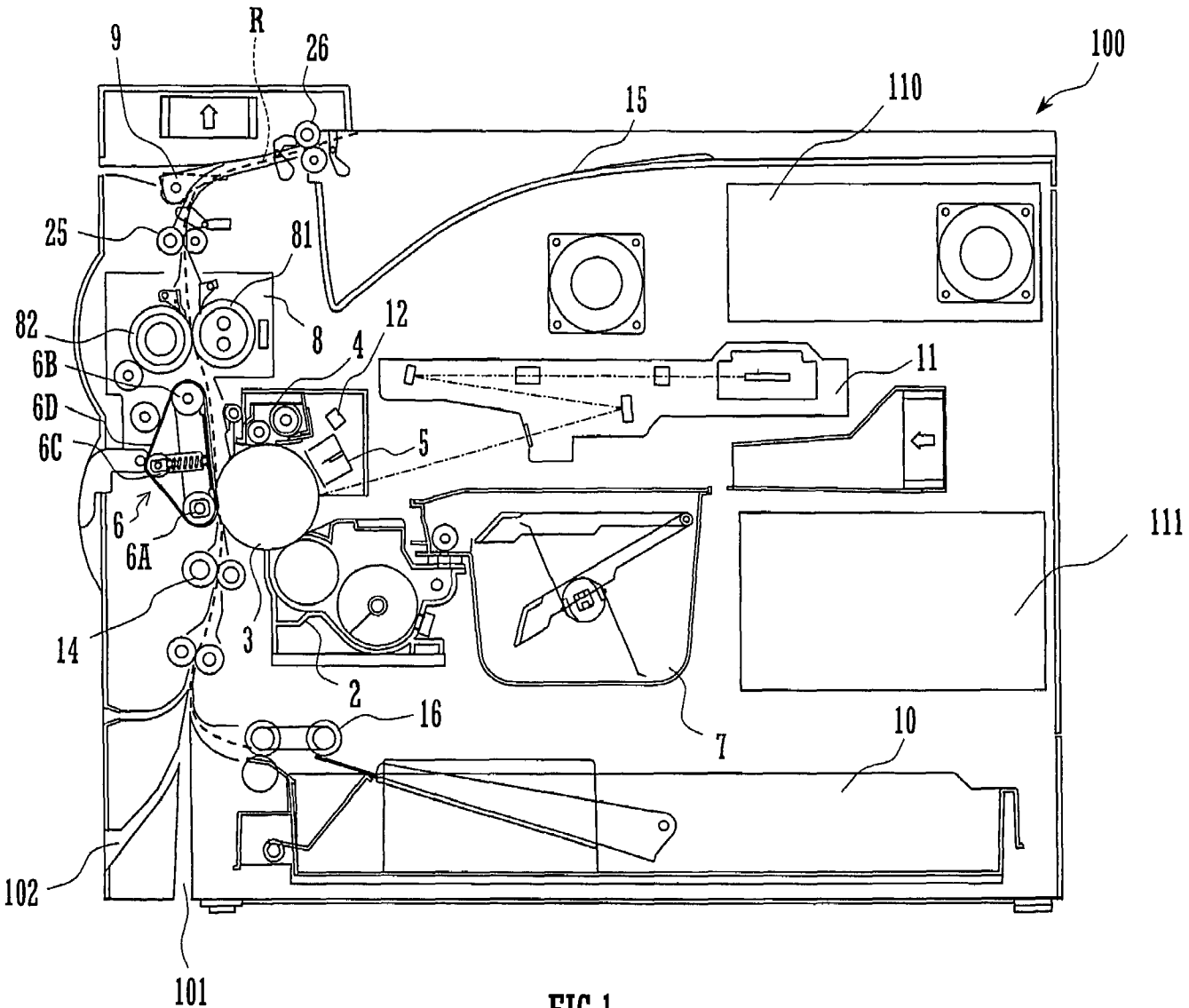
FIG. 1 is a view showing an example of the construction of an image forming apparatus according to an embodiment of the present invention.

FIG. 1 is a view showing an example of the construction of an image forming apparatus incorporating a transfer device according to an embodiment of the present invention. The image forming apparatus 100 shown has a feed tray 100 in a lower portion thereof, the feed tray 100 being capable of holding recording sheets on each of which an image is to be formed. In an upper portion of the image forming apparatus there is provided a delivery tray 15 for receiving recording sheets each bearing an image formed thereon. A vertically extending sheet feed path R is defined between the feed tray 10 and the delivery tray 15. The feed tray 10 is provided with a pick-up roller 16 for feeding the recording sheets held in the feed tray 10 to the sheet feed path R one by one.

A photosensitive drum 3 as the image carrier of the present invention is located adjacent the sheet feed path R. The photosensitive drum 3 is an image carrier for carrying an image to be transferred to a recording sheet being fed on the sheet feed path R. Around the photosensitive drum 3 are disposed an electrostatic charger 5, an optical scanning unit 11, a developing unit 2, a transfer device 6, a cleaner unit 4 and a static eliminator lamp 12.

The electrostatic charger 5 electrostatically charges the surface of photosensitive drum 3 uniformly. The optical scanning unit 11 irradiates the uniformly charged surface of the photosensitive drum 3 with an optical image thereby to write an electrostatic latent image to the photosensitive drum 3. The developing unit 2 feeds toner contained in a developer container 7 to the electrostatic latent image formed on the surface of the photosensitive drum 3 to form a toner image. The cleaner unit 4 removes residual toner remaining on the surface of the photosensitive drum 3. The static eliminator lamp 12 eliminates electrostatic charge remaining on the surface of the photosensitive drum 3.

Registration rollers 14 are located on the sheet feed path R upstream of the photosensitive drum 3. The registration rollers 14 time the feeding of each recording sheet to an image forming position (transfer nip area) between the photosensitive drum 3 and a transfer electrode roller 6A.

Further, the image forming apparatus 100 has a lower portion provided selectively with a non-illustrated sheet feeder including a multi-tier sheet tray and a non-illustrated large-capacity sheet feeder capable of holding a large amount of recording sheets as peripheral devices. The image forming apparatus 100 has a sheet-receiving section 101 for receiving each recording sheet to be guided from the sheet feeder to the image forming position, and an extension sheet-receiving section 102 for receiving each recording sheet to be guided from the large-capacity sheet feeder to the image forming position, the sheet-receiving sections 101 and 102 being located adjacent the sheet feed tray 10.

A fixing device 8 is disposed on the sheet feed path R downstream of the photosensitive drum 3. The fixing device 8 includes a fixing roller 81 and a pressure roller 82, which are positioned on opposite sides across the sheet feed path R. The fixing device 8 fixes an unfixed toner image transferred to each recording sheet being transported on the sheet feed path R by heat and pressure produced from the fixing roller 81 and pressure roller 82.

Feed rollers 25 and a switch gate 9 are disposed downstream of the fixing roller 81 in the sheet feed direction. The feed rollers 25 feed each recording sheet having passed through the fixing device 8 further downstream in the sheet feed direction. The switch gate 9 selectively opens one of feed paths on which the recording sheet is to be fed by the feed rollers 25.

Above the optical scanning unit 11 is disposed a control section 110 including a circuit board for controlling image formation processing and an interface board for receiving image data from external equipment. Below the optical scanning unit 11 is disposed an electric power unit 111 for supplying electric power to each of the aforementioned sections or parts of the image forming apparatus 100.

Figure 2:
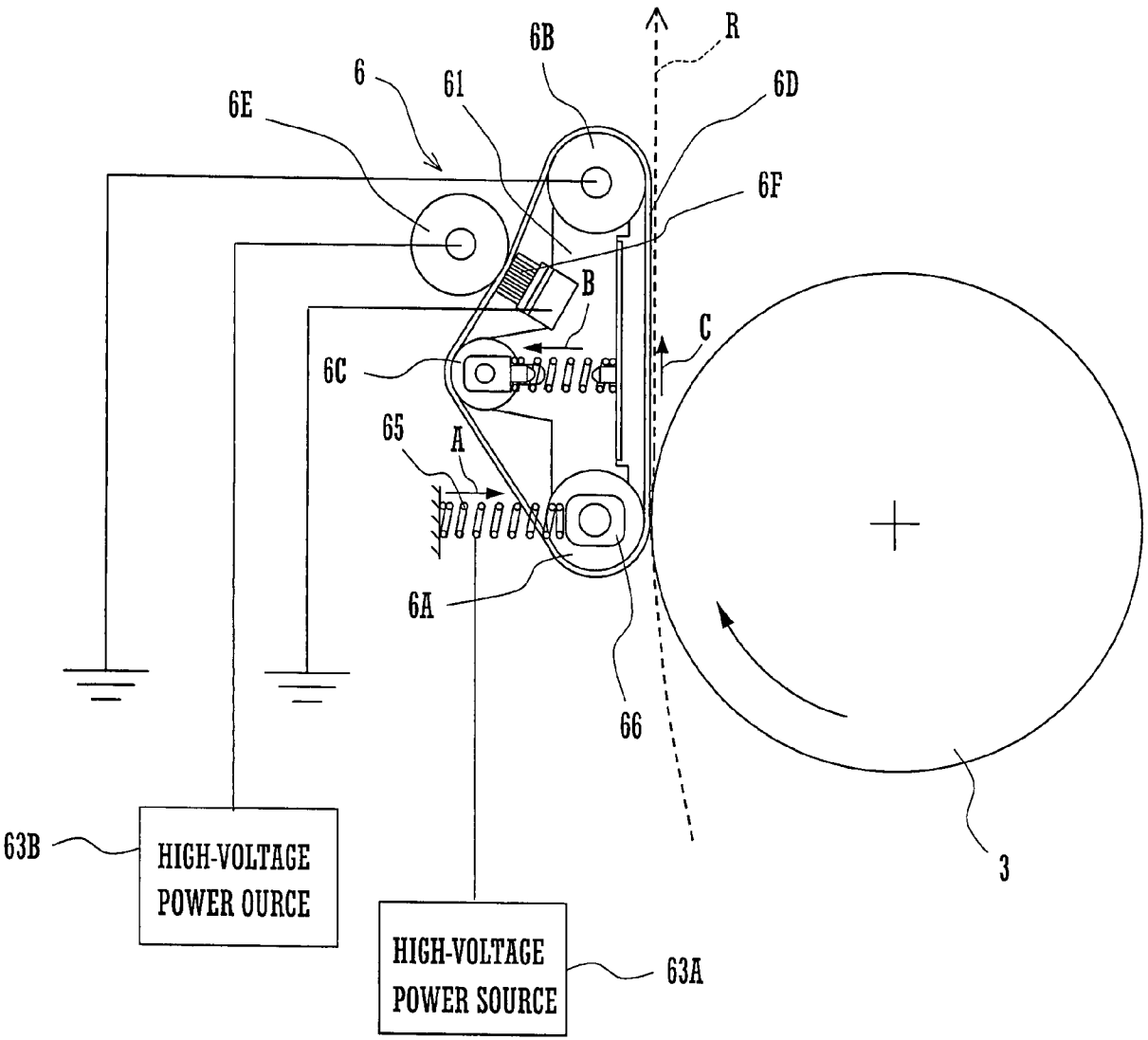
FIG. 2 is a view showing an example of the construction of a transfer device according to an embodiment of the present invention.

FIG. 2 shows the construction of the aforementioned transfer device 6. The transfer device 6 is positioned to face the photosensitive drum 3 at a location adjacent the sheet feed path R and transfers a toner image formed on the surface of the photosensitive drum 3 to a recording sheet on the sheet feed path R. The transfer device 6 includes transfer electrode roller 6A, driving roller 6B, tension roller 6C, transfer belt 6D as the transfer carrier of the present invention, auxiliary cleaning roller 6E as the auxiliary cleaning member of the present invention, and brush electrode 6F.

The transfer device 6 further includes high-voltage power sources 63A and 63B. The high-voltage power source 63A selectively applies transfer bias and cleaning bias to the transfer belt 6D via the transfer electrode roller 6A. The high-voltage power source 63B applies auxiliary bias to the auxiliary cleaning roller 6E.

The transfer device 6 transfers a toner image formed on the surface of the photosensitive drum 3 to a recording sheet during the transfer operation and transports the recording sheet bearing the toner image transferred thereto in the sheet feed direction indicated by arrow C. The auxiliary cleaning roller 6E temporarily attracts thereto useless toner adhering to the transfer belt 6D during the transfer operation, thereby preventing the useless toner adhering to the transfer belt 6D from soiling the reverse side of the succeeding recording sheet.

Further, the transfer device 6 performs a cleaning operation including returning the useless toner attracted to the auxiliary cleaning roller 6E to the photosensitive drum 3 via the transfer belt 6D with predetermined timing and then causing the cleaner unit 4 to collect the returned toner. Such a cleaning operation is performed because if the auxiliary cleaning roller 6E is caused to attract a larger amount of useless toner than the toner attracting capacity of the auxiliary cleaning roller 6E which is limited, excess toner scatters and soils the inside of the image forming apparatus 100.

The transfer device 6 includes a transfer unit frame 61. The transfer unit frame 61 supports transfer electrode roller 6A, driving roller 6B, tension roller 6C and auxiliary cleaning roller 6E for their rotation while mounting brush electrode 6F thereon.

The transfer electrode roller 6A is rotatably supported at its opposite ends by an electrically conductive bearing 66 opposed to the photosensitive drum 3 and is in contact with the photosensitive drum 3 via the transfer belt 6D. The electrically conductive bearing 66 is coupled to a compression spring 65. Accordingly, the transfer electrode roller 6A is biased toward the photosensitive drum 3 (in the direction indicated by arrow A) by the compression spring 65 via the electrically conductive bearing 66.

The compression spring 65 is a coiled spring formed of steel wire for spring such as stainless steel wire for example. The biasing force applied to the electrically conductive bearing 66 by the compression spring 65 is about 0.5 to about 1.5 kg on one side of the transfer electrode roller 6A. Therefore, the transfer electrode roller 6A, as a whole, is applied with a biasing force of about 1 to about 3 kg from the compression spring 65. This force is slightly offset downstream in the sheet feed direction from the line interlinking the transfer electrode roller 6A and the center of the photosensitive drum 3.

The transfer electrode roller 6A comprises a core formed of a rod material of stainless steel or other iron material, and an electrically conductive foamed resilient layer formed over the periphery of the core. The foamed resilient layer is formed from urethane rubber, NBR (acrylonitrile-butadiene rubber), or a like material. The foamed resilient layer has a volume resistivity of about $10^5$ to about $10^7$ Ω·cm and a hardness of 45 to 60 degrees in terms of JIS-C (Ascar C). The transfer electrode roller 6A has an outside diameter of about 14 mm in this embodiment.

Further, the transfer electrode roller 6A is connected to the high-voltage power source 63A via the compression spring 65 and electrically conductive bearing 66. During the transfer operation the high-voltage power source 63A applies transfer bias having a polarity reverse of the polarity of electrostatically charged toner to the transfer belt 6D via the compression spring 65, electrically conductive bearing 66 and transfer electrode roller 6A. The high-voltage power source 63A, compression spring 65, electrically conductive bearing 66 and transfer electrode roller 6A constitute the bias applying section of the present invention.

In the present embodiment, toner is negatively charged and, hence, positive transfer bias is applied to the transfer belt 3 via the transfer roller electrode 6A during the transfer operation. During the cleaning operation, on the other hand, the transfer belt 3 is applied with negative cleaning bias via the transfer electrode roller 6A. It is to be noted that the foamed resilient layer may consists of a single layer or plural layers.

The driving roller 6B is located downstream of the transfer electrode roller 6A in the sheet feed direction. The driving roller 6B is rotated counterclockwise in the relevant figures by the rotational force transmitted from a drive motor to be described later. The driving roller 6B is a metallic roller of stainless steel or aluminum. This is because the metallic driving roller 6B can obviate a frictional resistance problem which would otherwise arise between the driving roller 6B and the transfer belt 6D formed of a rubber material while preventing vibration and the like from generating by virtue of its increased outside diameter precision. The core of the driving roller 6B is grounded.

The tension roller 6C is a metallic roller exerting a force of about 2.4 kg on the transfer belt 6D in the direction away from the sheet feed direction R (in the direction indicated by arrow B). In this embodiment, a roller formed by working a stainless steel rod material is used as the tension roller 6C. Where the space provided for the transfer device 6 has leeway, the tension roller 6C may be formed of an aluminum material and have an increased outside diameter. The tension roller 6C may be eliminated if the auxiliary cleaning roller 6E is imparted with a tension-applying function.

The transfer belt 6D comprising urethane or NBR as a major material is shaped into an endless form by extrusion, centrifugal molding or a like process. The transfer belt 6D is electrically conductive and has a thickness of about 0.5 to 0.65 mm. The surface of the transfer belt 6D is coated with fluorine. The transfer belt 6D has a volume resistivity of $10^9$ to $10^{11}$ Ω·cm.

The auxiliary cleaning roller 6E has the same structure as the transfer electrode roller 6A. The auxiliary bias to be applied from the high-voltage power source 63B to the auxiliary cleaning roller 6E includes attraction bias to be applied during the transfer operation and delivery bias to be applied during the cleaning operation. For example, the attraction bias is +2.0 to +2.5 KV and the delivery bias is −2.0 to −2.5 KV.

Figure 7:
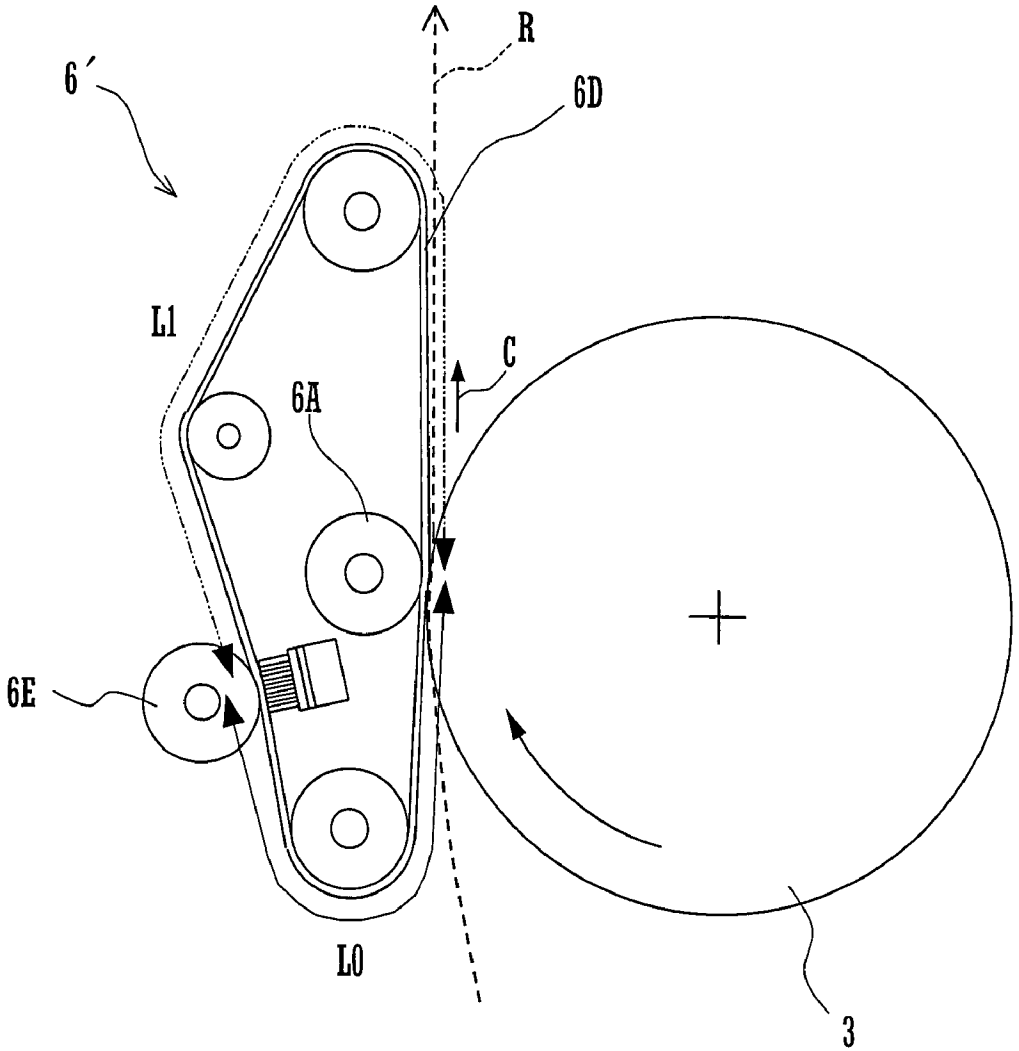
FIG. 7 is a view illustrating the position of an auxiliary cleaning roller in a transfer device according to another embodiment of the present invention.

FIG. 7 is a view showing the construction of a transfer device according to another embodiment of the present invention. In transfer device 6' according to this embodiment, the distance L0 from the transfer electrode roller 6A to the auxiliary cleaning roller 6E on the upstream side of the transfer electrode roller 6A in the moving direction of the transfer belt 6D is set shorter than the distance L1 from the transfer electrode roller 6A to the auxiliary cleaning roller 6E on the downstream side of the transfer electrode roller 6A in the moving direction of the transfer belt 6D.

With this arrangement, the distance the transfer belt 6D has to transport useless toner delivered from the auxiliary cleaning roller 6E is shortened, whereby the time required for useless toner attracted to the auxiliary cleaning roller 6E to be returned to the photosensitive drum 3 via the transfer belt 6D can be shortened.

The brush electrode 6F, which is the auxiliary cleaning electrode of the present invention, is opposed to the auxiliary cleaning roller 6E across the transfer belt 6D. The brush electrode 6E is, for example, an electrically conductive brush manufactured by filling, having a resistance of $10^6$ Ω, a width of 5 mm, a bristle length of 6 mm, a length of 314 mm perpendicular to the sheet feed direction, and a bristle density of 100 to 300/cm$^2$. Like the rollers other than the transfer electrode roller 6A, the brush electrode 6F is grounded.

Figure 8A:
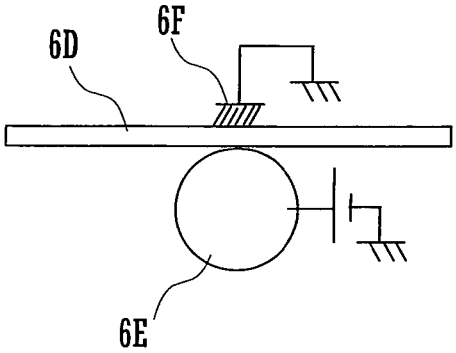
FIGS. 8A to 8C illustrate the relationship between the voltage applied to each of a brush electrode and a roller electrode as auxiliary cleaning electrodes and the resulting current value.
Figure 8B:
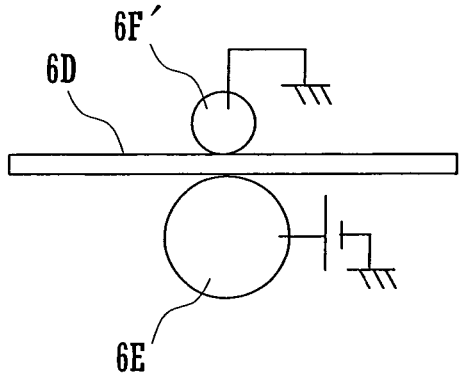
Figure 8C:
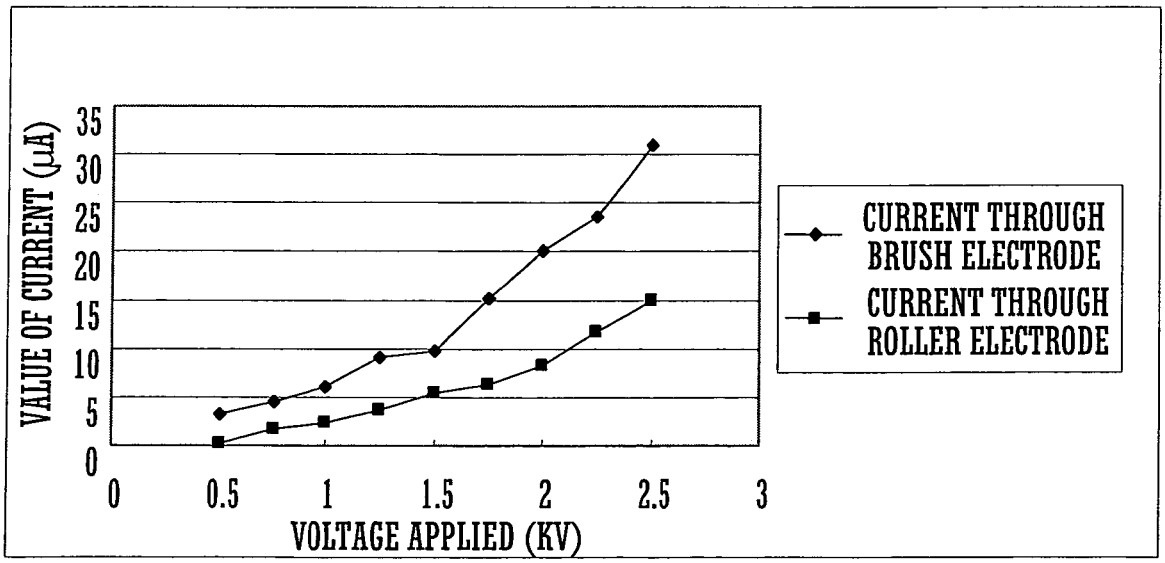

Instead of the brush electrode 6F, an electrode in the form of roller, such as a sponge roller, may be used. FIG. 8C shows, however, that according to experiments, the use of the brush electrode 6F shown in FIG. 8A allowed a higher current to pass through the transfer belt 6D via the auxiliary cleaning roller 6E than did the use of the sponge roller electrode 6F' shown in FIG. 8B.

Conceivably, this is because the brush electrode 6F contacted a larger area of the transfer belt 6D than the sponge roller electrode 6F' and hence allowed current resulting from the voltage applied to the auxiliary cleaning roller 6E to pass through the transfer belt 6D more easily and stably. It should be noted that the brush electrode 6F has a resistance of $4.6\times10^{6}$ Ω and the sponge roller electrode 6F' has a resistance of $1.9\times10^{6}$ Ω.

Thus, the brush electrode 6F ensures enhanced cleaning performance. Further, the brush electrode 6D is capable of attracting toner, dust and the like adhering to the reverse side of the transfer belt 6D and hence can ensure that the transfer belt 6D maintains stable mobility for a long time. The auxiliary cleaning electrode, such as the brush electrode 6F, is not an essential element of the present invention.

Figure 3:
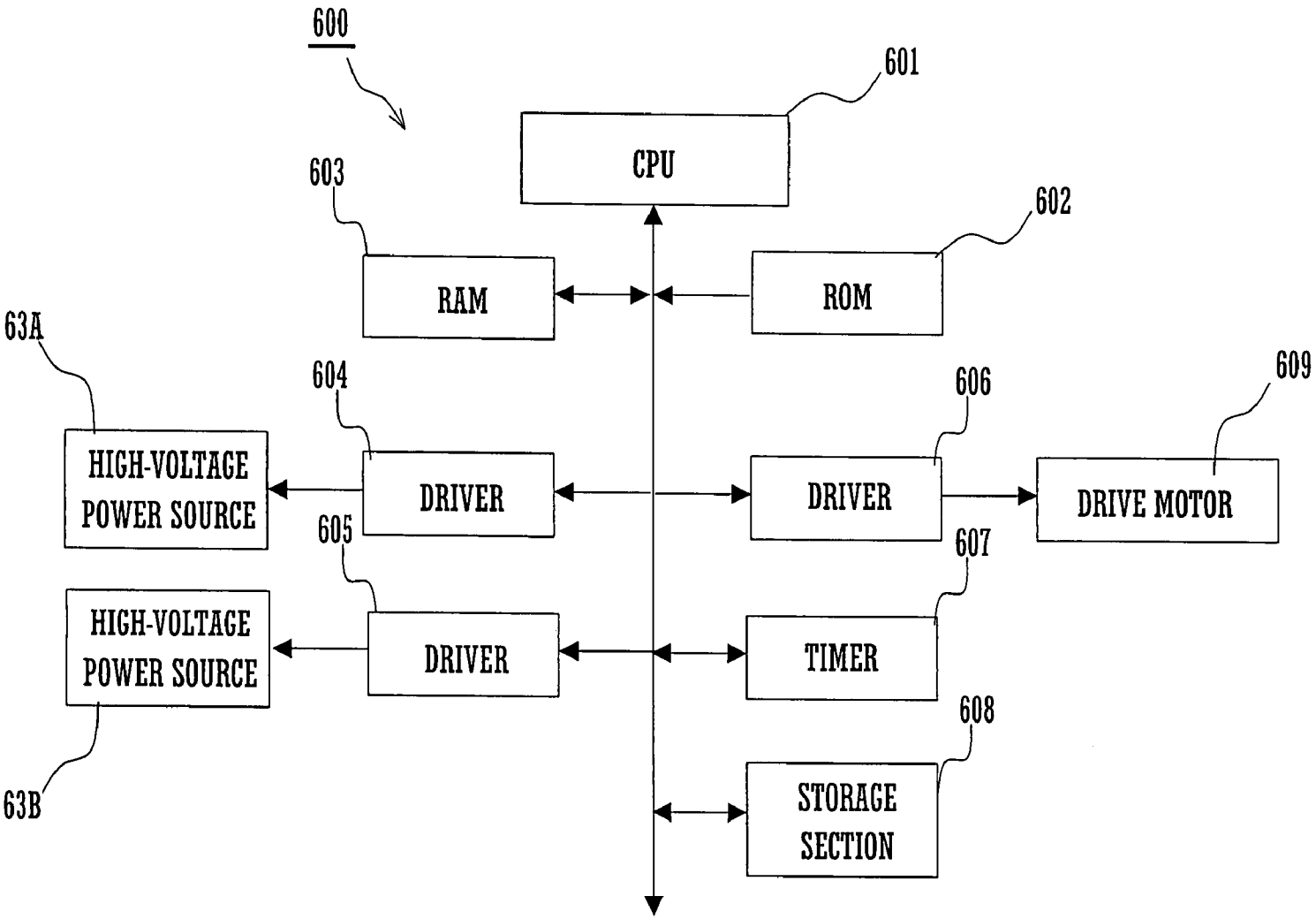
FIG. 3 is a diagram illustrating the configuration of a control section controlling the operation of the transfer device.

FIG. 3 shows the configuration of the control section for controlling the operation of the transfer device. In the present embodiment, control section 600 for controlling the operation of the transfer device 6 is incorporated in control section 110 of the image forming apparatus 100. However, the control section 600 may be incorporated into the transfer device 6.

The control section 600 includes a CPU 601 and input/output devices connected to the CPU 601, the input/output devices including ROM 602, RAM 603, drivers 604 to 606, timer 607, storage section 608 and the like. The ROM 602 has stored therein a program and the like needed for the operation of the transfer device 6. The RAM 603 is volatile memory for temporarily storing necessary data therein.

The drivers 604 and 605 drive the high-voltage power sources 63A and 63B, respectively. The driver 606 drives the drive motor 609. The revolution of the drive motor 609 is transmitted to the driving roller 6B.

The timer 607 clocks the transfer operation by accumulating transfer execution periods. When the accumulated value of transfer execution periods reaches a predetermined value, the timer 607 outputs a time-up signal to the CPU 601 and then clears the accumulated value. The timer 607 clocks a sheet feed period or a transfer bias application period as a transfer execution period.

The storage section 608 serving as the storage section of the present invention stores therein information about the operating status of the transfer device 6, for example, about an updated accumulated value of transfer execution periods. The storage section 608 comprises nonvolatile memory or volatile memory with battery backup. Therefore, even when application of power to the image forming apparatus 100 is cut off, data or information stored in the storage section 608 is retained without interruption. When application of power to the image forming apparatus 100 is resumed, the storage section 608 allows the data or information stored therein to be read and hence allows processing to be performed continuously with the operating status just before the cutoff of power.

For example, the CPU 601 saves data on the time period clocked by the timer 607 upon the cutoff of application of power to the image forming apparatus 100. When application of power to the image forming apparatus 100 is resumed, the CPU 601 sets the timer 607 to the clocked time period stored in the storage section 608.

The CPU 601 coordinates and controls the input/output devices according to the program stored in the ROM 602. During the transfer operation performed in the electrophotographic image forming process based on the photosensitive drum 3, the CPU 601 causes the high-voltage power source 63A to apply the transfer bias to the transfer electrode roller 6A while causing the high-voltage power source 63B to apply the attraction bias to the auxiliary cleaning roller 6E. Further, the CPU 601 executes the cleaning operation at the time the time-up signal is inputted from the timer 607. Specifically, the CPU 601 causes the high-voltage power source 63 A to apply the cleaning bias to the transfer electrode roller 6A while causing the high-voltage power source 63B to apply the delivery bias to the auxiliary cleaning roller 6E, in order to return toner attracted to the auxiliary cleaning roller 6E to the photosensitive drum 3 via the transfer belt 6D.

Figure 5A:
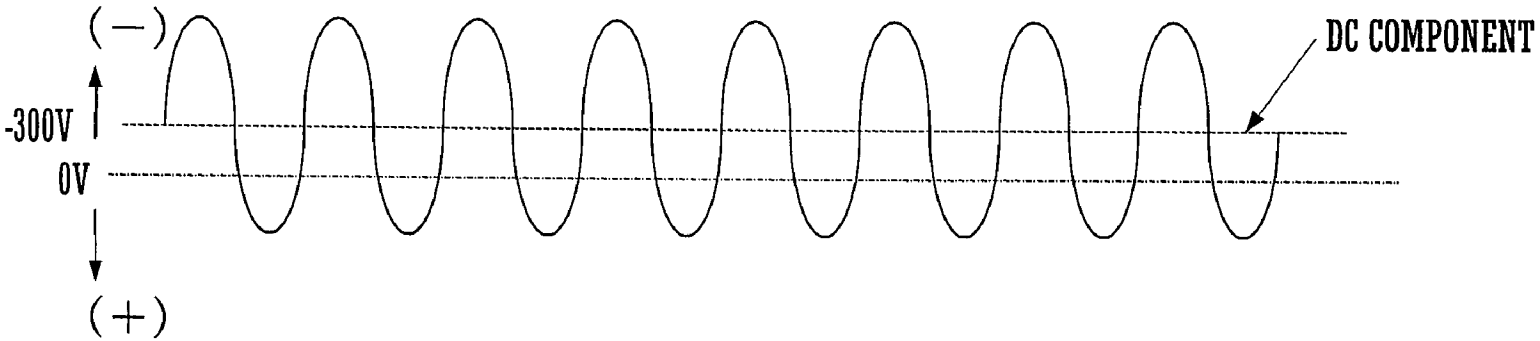
FIGS. 5A to 5C are waveform charts of cleaning bias.
Figure 5B:
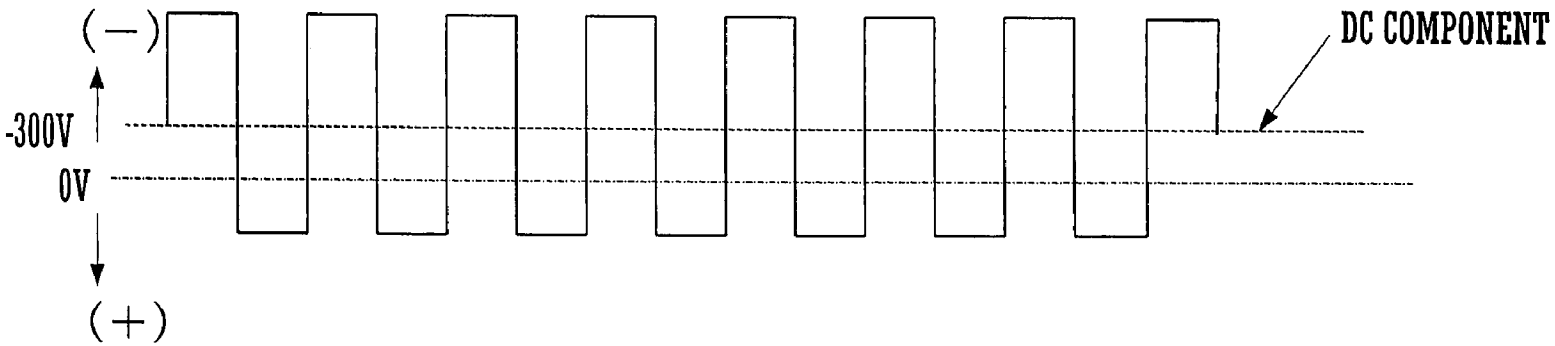
Figure 5C:
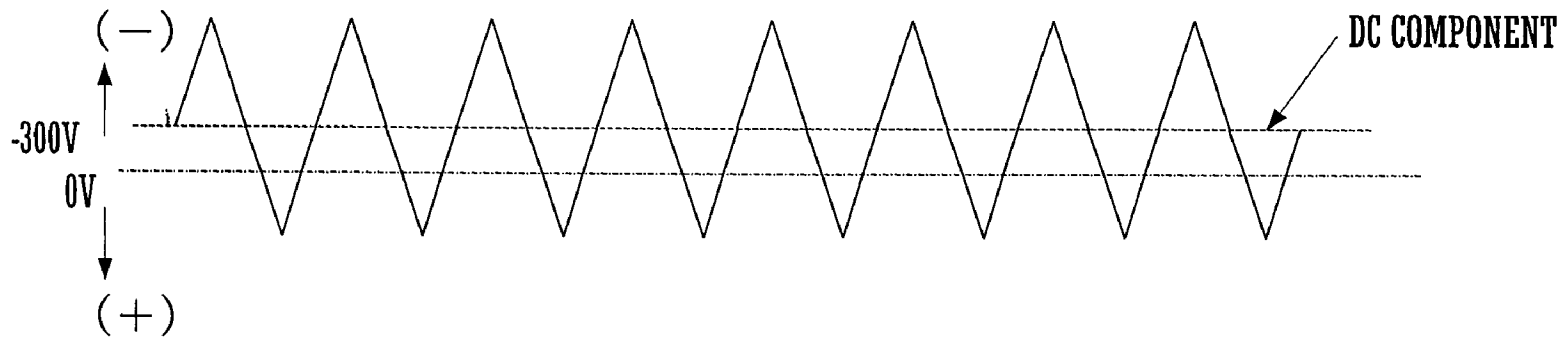

The power source circuit 63A includes a DC transformer and an AC transformer connected in series and outputs cleaning bias from both of these transformers. The DC transformer outputs a voltage of −100 V to −300 V, while the AC transformer outputs a voltage of 4.5 KVpp to 5.0 KVpp (having a frequency of 100 Hz to 500 Hz). Accordingly, the cleaning bias has, for example, a sine wave having an amplitude comprising 2.5 KV on the plus side and 2.5 KV on the minus side from the center assuming −300 V, as shown in FIG. 5A. The cleaning bias is not limited to the sine wave. A rectangular wave as shown in FIG. 5B or a triangular wave as shown in FIG. 5C can produce a similar effect as does the sine wave.

A conventional transfer device is configured to apply only a DC component having a polarity reverse of that of electrostatically charged toner as the cleaning bias to clean the transfer belt 6D utilizing the resulting electrical repulsive force. However, application of the cleaning bias consisting only of such a DC component cannot exercise a sufficient cleaning effect and, hence, the transfer device according to the present embodiment is configured to apply the cleaning bias comprising a DC component and an AC component superimposed on the DC component.

The high-voltage power source 63A is controlled so that a constant current of 30 to 50 μA passes through the transfer electrode roller 6A. The voltage to be applied from the high-voltage power source 63 to the transfer electrode roller 6A varies between 500 V and 4 KV depending on the material of a recording sheet to be used and environmental conditions. Usually, the transfer bias is fed toward the core of the transfer electrode roller 6A via the compression spring 65 and the electrically conductive bearing 66.

The range of the AC bias is established as noted above because it was experimentally demonstrated that the cleaning effect was satisfactory when the AC potential was 4.0 kV or more. If the AC potential is raised too high, leakage from the unit to the periphery is likely, which gives rise to a need for countermeasure against leakage, while at the same time the chargeability of the photosensitive drum 3 is likely to be damaged.

Specifically, electrostatically charged toner particles adhere to the transfer belt 6D by Coulomb force and van der Waals' force. Since the Coulomb force is an electrical attractive force, toner can be released from the transfer belt 6D by application of bias having reversed polarity. On the other hand, the van der Waals' force (intermolecular attraction) is a force ascribable to the distance from one particle to another, toner particles cannot be moved unless a mechanical force is applied. That is, only toner on which the Coulomb force (electrical attraction) is predominantly exerted can be electrically cleaned, whereas toner that is electrically charged to a low level or with a revered polarity cannot be electrically cleaned. This is the reason why the transfer efficiency does reach 100% theoretically.

Toner particles that are present in a lower part of particle layers and closely adhere to the transfer belt 6D are intensively dominated by the van der Waals's force rather than the Coulomb force and hence cannot be cleaned unless they are moved mechanically. Such mechanical attraction based on the van der Waals' force can be lessened if toner is given a lateral moment by increasing the ratio between the circumferential velocity of the photosensitive drum 3 and the velocity of a recording sheet to cause the recording sheet to slip on the surface of the photosensitive drum 3. With this approach, however, the circumferential velocity of the photosensitive drum 3 is different from that of the transfer belt 6D, which causes the image to expand and contract and hence causes the image forming magnification to vary.

For the purpose of avoiding such an inconvenience, the amplitude component of the AC bias is applied to toner to cause the toner to float electrically in the very small gap of the transfer nip between the photosensitive drum 3 and the transfer belt 6D, thereby increasing the distance from one toner particle to another, hence, weakening the mechanical attraction therebetween. With the mechanical attraction among toner particles being thus weakened by the AC bias, the DC bias having a polarity reverse of the polarity of the toner is applied to the transfer nip to generate electrically repulsive force among the toner particles, whereby the toner can be moved to the photosensitive drum 3.

According to the experiment, DC bias exhibiting a cleaning effect was in the range from about 0 V to about −300 V. If DC bias exceeding this range is applied, the photosensitive drum 3 is electrostatically charged against the intention thereby lessening the cleaning effect. An AC bias of 4 KVpp or more produced a satisfactory cleaning effect. If the potential of AC bias is too high, leakage to the periphery of the transfer device 6 is likely, which gives rise to a need for countermeasure against leakage, while at the same time the chargeability of the photosensitive drum 3 is likely to be damaged considerably. Such problems will not occur when the AC bias falls in the range from 4 KVpp to 4.5 KVpp.

Figure 6:
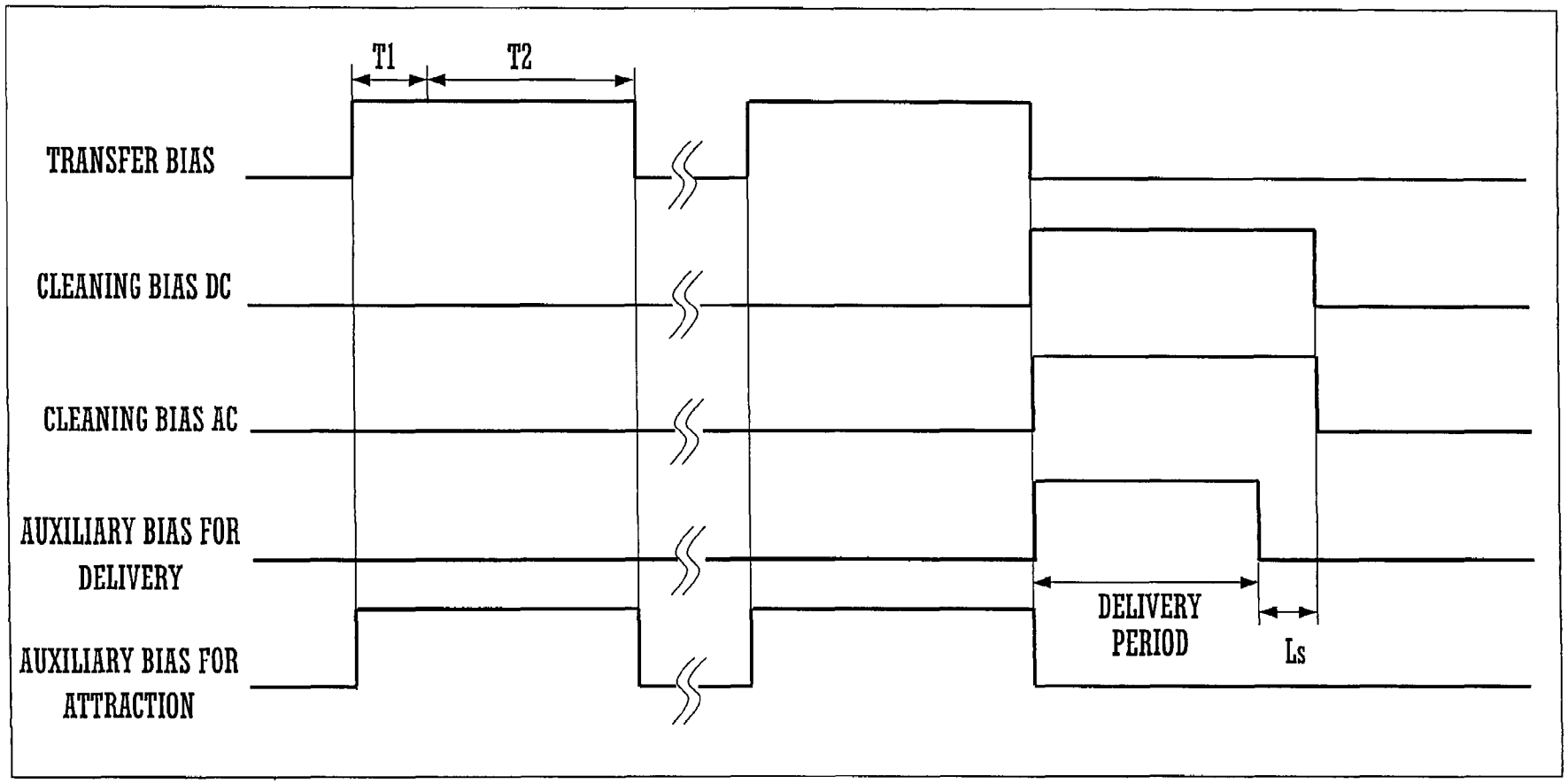
FIG. 6 is a timing chart of transfer bias, cleaning bias and auxiliary bias.

FIG. 6 is a timing chart for illustrating how each bias is applied in the aforementioned transfer device. As described earlier, during the transfer operation for transferring a toner image formed on the photosensitive drum 3 to a recording sheet, the high-voltage power source 63A applies the transfer bias to the transfer belt 6D while the high-voltage power source 63B applies the attraction bias to the auxiliary cleaning roller 6E. The auxiliary cleaning roller 6E attracts thereto toner adhering to the transfer belt 6D during the transfer operation in which the auxiliary cleaning roller 6E is under application of the attraction bias having positive polarity by the high-voltage power source 63B. The time period during which the transfer bias is applied includes not only an actual application period during which a recording sheet is present between the photosensitive drum 3 and the transfer belt 6D but also a pre-application period consisting of a predetermined time period before the recording sheet reaches the transfer nip between the photosensitive drum 3 and the transfer belt 6D. In FIG. 6, the transfer operation period consists of the total of pre-application period T1 and actual application period T2.

During the cleaning operation for returning toner attracted on the auxiliary cleaning roller 6E to the photosensitive drum 3 via the transfer belt 6D, the high-voltage power source 63A applies the cleaning bias comprising a DC component and an AC component superimposed on the DC component to the transfer belt 6D while at the same time the high-voltage power source 63B applies the delivery bias having negative polarity to the auxiliary cleaning roller 6E, thereby causing the auxiliary cleaning roller 6E to deliver toner attracted thereto to the transfer belt 6D.

Figure 4:
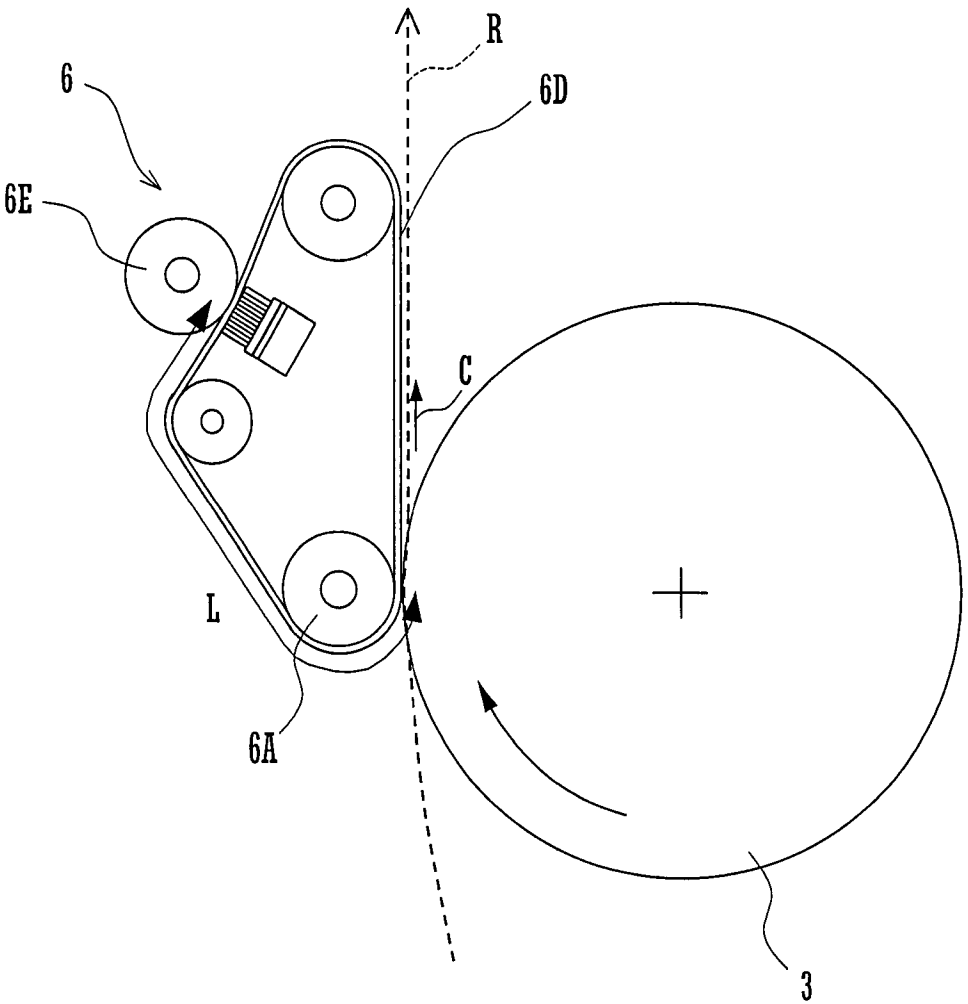
FIG. 4 is a view illustrating the position of an auxiliary cleaning member.

In the cleaning operation in which the cleaning bias is applied from the high-voltage power source 63A to the transfer electrode roller 6A, the auxiliary cleaning roller 6E is applied with the delivery bias for a time period shorter by a predetermined time period Ls than the cleaning bias application period. The predetermined time period Ls is equal to the time period in which a point on the transfer belt 6D travels from a location opposite to the auxiliary cleaning roller 6E to a location opposite to the photosensitive drum 3 (distance L shown in FIG. 4). This arrangement is capable of returning all the toner delivered to the transfer belt 6D to the photosensitive drum 3 without leaving any fraction of toner on the transfer belt 6E.

The cleaning operation is performed at the time the accumulated value of transfer execution periods obtained by the operations of the aforementioned timer 607 and storage section 608 reaches the predetermined value. Therefore, the cleaning operation is performed not only when the accumulated value of transfer execution periods during which the transfer operation is executed successively on plural recording sheets reaches the predetermined time period but also when the accumulated value of transfer execution periods during which the transfer operation is performed plural times intermittently with intervening cutoff and resumption of application of power to the image forming apparatus 100. The predetermined time period is determined based on the toner attracting capacity of the auxiliary cleaning roller 6E. The accumulated value of transfer execution periods corresponds to an amount of execution of the transfer operation of the present invention.

Thus, useless toner is returned to the photosensitive drum 3 via the transfer belt 6D before the auxiliary cleaning roller 6E attracts useless toner in an amount exceeding the attracting capacity thereof. Therefore, useless toner cannot be released from the auxiliary cleaning roller 6E on an undesirable occasion and, hence, the apparatus can be reliably prevented from being soiled and damaged.

In case of an emergency stop of the image forming apparatus 100 due to such a trouble as the occurrence of a recording sheet jam during feeding or sudden cutoff of power to the image forming apparatus 100, it is possible that a large amount of toner adheres to the transfer belt 3 as well as the auxiliary cleaning roller 6E. In view of this, the transfer device 6 may be configured to perform the cleaning operation forcibly in case of such an emergency stop of the image forming apparatus 100 due to the occurrence of a trouble.

The transfer device 6 may be configured to perform the cleaning operation at the time image formation processing on ten A4-size recording sheets for example has been completed. In this case, the transfer device 6 has a counter for counting the number of recording sheets each formed with an image on an A4 size basis, instead of the timer 607. Accordingly, if the recording sheets used are of A3 size, the cleaning operation is performed upon completion of image formation on five recording sheets.

With an image forming apparatus having an image forming rate of 60 sheets per minute, image formation on ten A4-size sheets takes ten seconds, i.e., 1 sec×10 sheets. Thus, the transfer device 6 may be configured to perform the cleaning operation every time the timer 607 clocks accumulated ten seconds.

Alternatively, the transfer device 6 may be configured to accumulate transfer bias application periods and perform the cleaning operation at the time the accumulated value reaches a predetermined time period.

FIG. 6 is a timing chart of bias application where the transfer bias is turned on/off for each recording sheet in successive image formation on plural recording sheets. Alternatively, the image forming apparatus may be configured to control so that the transfer bias is continuously applied without being turned off. In this configuration the accumulated value of transfer bias application periods is equal to the accumulated value of transfer device operation periods (net time periods during each of which the transfer device operates). On the other hand, in the former configuration in which the transfer bias is turned off between adjacent recording sheets, the accumulated value of transfer bias application periods is slightly smaller than the accumulated value of transfer device operation periods.

Accordingly, the transfer device operation period established in the configuration for continuously applying the transfer bias even between adjacent recording sheets need be shorter than in the configuration in which the transfer bias is turned off between adjacent recording sheets. It is therefore preferable that the cleaning operation executing timing is established based on the accumulated value of actually clocked transfer bias application periods. From the practical point of view, required control becomes simpler if the cleaning operation executing timing is established based on only the accumulated number of recording sheets having undergone the transfer operation.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. A transfer device comprising:

an endless transfer carrier entrained about plural support members and movable along a looped path;

a bias applying section operative to selectively apply transfer bias or cleaning bias to the transfer carrier;

an auxiliary cleaning member operative to temporarily attract thereto toner adhering to the transfer carrier;

a control section for executing a transfer operation including an operation for causing the bias applying section to apply the transfer bias to the transfer carrier so as to transfer toner from a surface of an image carrier to a recording sheet being transported by the transfer carrier, and an operation for causing the auxiliary cleaning member to attract thereto toner adhering to the transfer carrier, and an accumulating section operative to accumulate transfer execution time periods as an accumulated value, wherein the control section is operative to initiate a cleaning operation including returning the toner attracted to the auxiliary cleaning member to the image carrier via the transfer carrier when the accumulated value reaches a predetermined value.

2. The transfer device according to claim 1, wherein the accumulating section accumulates as the accumulated value time periods during which the recording sheet is transported by the transfer carrier.

3. The transfer device according to claim 2, wherein:

the accumulating section outputs a time-up signal when the accumulated value reaches a predetermined value, and then clears the accumulated value, and wherein:

the control section executes the cleaning operation when the accumulating section outputs the time-up signal.

4. The transfer device according to claim 1, wherein the accumulating section accumulates as the accumulated value time periods during which the bias applying section applies the transfer bias.

5. The transfer device according to claim wherein:

the accumulating section outputs a time-up signal when the accumulated value reaches a predetermined value, and then clears the accumulated value, and wherein:

the control section executes the cleaning operation when the accumulating section outputs the time-up signal.

6. The transfer device according to claim 1, further comprising an auxiliary cleaning electrode opposed to the auxiliary cleaning member across the transfer carrier.

7. The transfer device according to claim 6, wherein the auxiliary cleaning electrode is a brush-shaped electrode.

8. The transfer device according to claim 1, wherein a distance from the bias applying section to the auxiliary cleaning member on a side upstream of the bias applying section in a direction in which the transfer carrier transports the recording sheet is shorter than a distance from the bias applying section to the auxiliary cleaning member on a side downstream of the bias applying section in the direction in which the transfer carrier transports the recording sheet.

9. The transfer device according to claim 1, wherein the predetermined value is determined based on a toner attracting capacity of the auxiliary cleaning member.

10. An electrophotographic image forming apparatus comprising:

a transfer device comprising:

an endless transfer carrier entrained about plural support members and movable along a looped path;

a bias applying section operative to selectively apply transfer bias or cleaning bias to the transfer carrier;

an auxiliary cleaning member operative to temporarily attract thereto toner adhering to the transfer carrier;

a control section for executing a transfer operation including an operation for causing the bias applying section to apply the transfer bias to the transfer carrier to transfer toner from a surface of an image carrier to a recording sheet being transported by the transfer carrier, and an operation for causing the auxiliary cleaning member to attract thereto the toner adhering to the transfer carrier, and an accumulating section operative to accumulate transfer execution time periods as an accumulated value;

wherein the control section is operative to initiate a cleaning operation including returning the toner attracted to the auxiliaxy cleaning member to the image carrier via the transfer carrier when the accumulated value reaches a predetermined value.

11. The image forming apparatus according to claim 10, further comprising:

a storage section operative to store at least information about an operating status of the transfer device assumed just before cutoff of application of power to the apparatus; and a control section operative to control the transfer device based on the information stored in the storage section when the application of power to the apparatus is resumed.

* * * * *